US010487811B2

(12) United States Patent
Matsuo et al.

(10) Patent No.: US 10,487,811 B2
(45) Date of Patent: Nov. 26, 2019

(54) VARIABLE DISPLACEMENT SWASH PLATE TYPE PISTON PUMP

(71) Applicant: KABUSHIKI KAISHA TOYOTA JIDOSHOKKI, Kariya-shi, Aichi-ken (JP)

(72) Inventors: Tsutomu Matsuo, Kariya (JP); Naoya Yokomachi, Kariya (JP); Yuki Ueda, Kariya (JP); Takashi Uno, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 0 days.

(21) Appl. No.: 16/069,205

(22) PCT Filed: Dec. 19, 2016

(86) PCT No.: PCT/JP2016/087775
§ 371 (c)(1),
(2) Date: Jul. 11, 2018

(87) PCT Pub. No.: WO2017/122501
PCT Pub. Date: Jul. 20, 2017

(65) Prior Publication Data

US 2019/0032645 A1 Jan. 31, 2019

(30) Foreign Application Priority Data

Jan. 14, 2016 (JP) ..... 2016-005426

(51) Int. Cl.
*F04B 1/32* (2006.01)
*F04B 1/20* (2006.01)
*F04B 53/16* (2006.01)

(52) U.S. Cl.
CPC ..... *F04B 1/324* (2013.01); *F04B 1/2064* (2013.01); *F04B 1/2078* (2013.01); *F04B 53/16* (2013.01)

(58) Field of Classification Search
CPC ..... F04B 1/20; F04B 1/2064; F04B 1/2078; F04B 1/324; F04B 53/16
See application file for complete search history.

(56) References Cited

U.S. PATENT DOCUMENTS 3,366,072 A 1/1968 Baits et al.
3,396,536 A * 8/1968 Miller ..... F04B 1/2064 91/506

(Continued)

FOREIGN PATENT DOCUMENTS

JP 4-32272 U 3/1992
JP 10159712 A 6/1998

(Continued)

OTHER PUBLICATIONS

Communication dated Oct. 8, 2018, from European Patent Office in counterpart application No. 16885103.8.

(Continued)

*Primary Examiner* — Michael Leslie
(74) *Attorney, Agent, or Firm* — Sughrue Mion, PLLC

(57) ABSTRACT

A variable displacement swash plate type piston pump includes first and second housing members fastened to each other by fastening members, a rotary shaft, a swash plate. A section of the inner circumferential surface of the first housing member has a recess. A bulging portion is arranged in a section of the outer circumferential wall of the first housing member. A section of the outer circumferential wall of the second housing member has a closing portion that closes the opening of the recess. The fastening members include first and second fastening members arranged at positions that are on the opposite sides of the recess, inside (Continued)

the width of the swash plate in a direction along the inclination axis of the swash plate, and closer to the rotary shaft than the distal ends of the bulging portion and the closing portion in the bulging direction.

3 Claims, 3 Drawing Sheets

(56) References Cited

U.S. PATENT DOCUMENTS

| | | | | |
|---|---|---|---|---|
| 7,082,762 | B1 * | 8/2006 | Trimble | F04B 1/2064 92/128 |
| 2015/0000513 | A1 * | 1/2015 | Funasaka | F04B 1/2078 91/505 |
| 2018/0306171 | A1 * | 10/2018 | Matsuo | F04B 1/2064 |
| 2018/0328350 | A1 * | 11/2018 | Matsuo | F04B 1/2035 |

FOREIGN PATENT DOCUMENTS

| | | | |
|---|---|---|---|
| JP | 2007092707 | A | 4/2007 |
| JP | 2011001162 | A | 1/2011 |

OTHER PUBLICATIONS

International Preliminary Report on Patentability and Translation of Written Opinion, dated Jul. 17, 2018 from the International Bureau in counterpart International application No. PCT/JP2016/087775.

* cited by examiner

Direction of Gravitational Force
Up
Down
51 (50)
52 (50)
53 (50)
54 (50)
12
13
14
14a
14h
16
18
18h
25
25a
31
32
32a
33
34b
37
38
39
41
42
42e
43
43a
43e
61
62
63
64
71
72
73
74
80

VARIABLE DISPLACEMENT SWASH PLATE TYPE PISTON PUMP

CROSS REFERENCE TO RELATED APPLICATIONS

This application is a National Stage of International Application No. PCT/JP2016/087775, filed on Dec. 19, 2016, which claims priority from Japanese Patent Application No. 2016-005426, filed on Jan. 14, 2016.

TECHNICAL FIELD

The present invention relates to a variable displacement swash plate type piston pump.

BACKGROUND ART

Patent Document 1, for example, discloses a conventional variable displacement swash plate type piston pump. The piston pump is capable of changing displacement of hydraulic oil (hydraulic fluid). The piston pump is used as, for example, a hydraulic pump mounted in an engine type forklift. A rotary shaft is rotationally supported in the housing of the piston pump. A cylindrical cylinder block is arranged in the housing. The rotary shaft is inserted into the cylinder block. The cylinder block is configured to be rotational integrally with the rotary shaft and has cylinder bores around the rotary shaft. The cylinder bores each accommodates a piston. A shoe is arranged at the end of each piston. The shoes are held by a retainer plate.

A swash plate is accommodated in the housing and has an angle of inclination (an inclination angle) changeable with respect to a direction perpendicular to the rotational axis of the rotary shaft. The surface of the swash plate opposed to the cylinder block is a flat sliding contact surface, on which the shoes slide. As the rotary shaft rotates and the cylinder block rotates integrally with the rotary shaft, the shoes slide on the sliding contact surface of the swash plate. This moves the pistons around the rotary shaft in the circumferential direction of the rotary shaft. Each of the pistons is thus reciprocated in the cylinder bore by the stroke corresponding to the inclination angle of the swash plate as the cylinder block rotates.

The swash plate includes a protrusion as a portion that contacts a control piston, which changes the inclination angle of the swash plate. The protrusion radially protrudes with respect to a section of the sliding contact surface. The housing of the variable displacement swash plate type piston pump has a first housing member and a second housing member both having a tubular shape with a bottom. The first housing member accommodates the cylinder block. The second housing member is coupled to the opening of the first housing member by means of a fastening tool such as bolts. The second housing member has a stopper. The opposite surface of the swash plate from the surface that contacts the control piston of the protrusion comes into contact with the stopper, thus limiting the inclination angle of the swash plate.

PRIOR ART DOCUMENT

Patent Document

Patent Document 1: Japanese Laid-Open Utility Model Publication No. 4-32272

SUMMARY OF THE INVENTION

Problems that the Invention is to Solve

When the piston pump having the above-described configuration limits the inclination angle of the swash plate, the protrusion comes into contact with the stopper of the second housing member after being moved by receiving force from the control piston. Therefore, the vicinity of the stopper in the second housing member is a section on which stress tends to concentrate relatively easily. That is, unless sufficient sealing performance is ensured in the sections of the first and second housing members corresponding to the protrusion of the swash plate, movement of the swash plate may deform the area of the housing around the section on which the stress concentrates. This may separate the first housing member from the second housing member. As a result, the hydraulic oil in the housing may leak from between the open end of the first housing member and the open end of the second housing member.

Accordingly, it is an objective of the present invention to provide a variable displacement swash plate type piston pump capable of ensuring a sufficient sealing performance in a section of the housing on which stress concentrates.

Means for Solving the Problems

To achieve the foregoing objective, a variable displacement swash plate type piston pump is provided that includes a housing, a rotary shaft, which is rotationally supported by the housing and has a rotational axis, a cylinder block, which is capable of rotating integrally with the rotary shaft, and a swash plate, which is accommodated in the housing and is inclinable about an inclination axis with respect to a direction perpendicular to the rotational axis of the rotary shaft. The swash plate includes a protrusion extending outward. The housing includes a tubular first housing member, which accommodates the cylinder block, and a tubular second housing member, which is coupled to an opening side of the first housing member. The first housing member has an inner circumferential surface and an outer circumferential wall. A section of the inner circumferential surface of the first housing member has a recess in which the protrusion is arranged. A piston accommodating chamber, which communicates with the recess, is provided in the first housing member at a position outward of the cylinder block in a radial direction of the rotary shaft. A bulging portion is arranged in a section of the outer circumferential wall of the first housing member by providing the recess and the piston accommodating chamber. The bulging portion bulges outward and extends in an axial direction of the first housing member. The second housing member has an outer circumferential wall. A section of the outer circumferential wall of the second housing member has a closing portion with a bottom that bulges outward along the bulging portion and closes an opening of the recess. A section of a bottom surface of the closing portion configures a stopper that the protrusion is capable of contacting. The piston accommodating chamber accommodates a control piston, which is capable of selectively protruding from and retracting into the piston accommodating chamber. The piston accommodating chamber and the control piston define a control pressure chamber. The first housing member and the second housing member are fastened to each other by means of a plurality of fastening members. The fastening members include a first fastening member and a second fastening member. The first and second fastening members are arranged at positions that are on opposite sides of the recess, inside a width of the swash plate in a direction along the inclination axis of the swash plate, and closer to the rotary shaft than distal ends of the bulging portion and the closing portion in a bulging direction.

MODES FOR CARRYING OUT THE INVENTION

A variable displacement swash plate type piston pump according to one embodiment will now be described with reference to FIGS. 1 to 4. The piston pump of the present embodiment is used as a hydraulic pump mounted in an engine type forklift.

Figure 1:
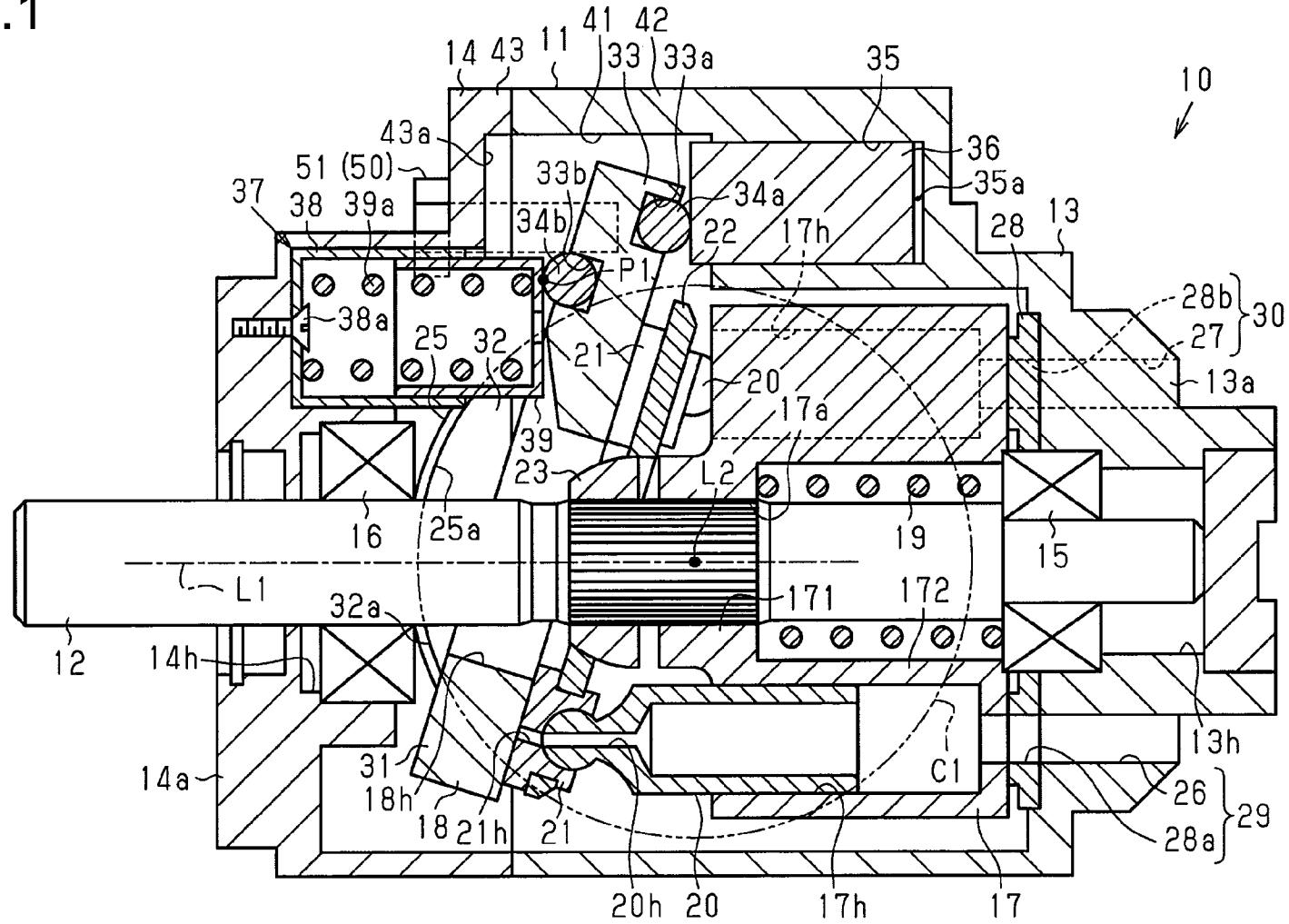
FIG. 1 is a cross-sectional side view showing a variable displacement swash plate type piston pump according to one embodiment.

As shown in FIG. 1, a variable displacement swash plate type piston pump 10 includes a housing 11 and a rotary shaft 12. The rotary shaft 12 is rotationally supported by the housing 11 and has a rotational axis L1. The housing 11 has a first housing member 13 and a second housing member 14 both having a tubular shape with a bottom. The second housing member 14 is coupled to the open end of the first housing member 13. The first housing member 13 and the second housing member 14 are joined to each other with the open ends facing and contacting each other.

A bottom wall 13*a* of the first housing member 13 has an insertion hole 13*h*. A section of the rotary shaft 12 corresponding to the first housing member 13 is inserted into the insertion hole 13*h*. The section of the rotary shaft 12 corresponding to the first housing member 13 is rotationally supported by the bottom wall 13*a* of the first housing member 13 with a bearing 15.

A bottom wall 14*a* of the second housing member 14 has an insertion hole 14*h*. A section of the rotary shaft 12 corresponding to the second housing member 14 is inserted into the insertion hole 14*h*. The section of the rotary shaft 12 on the side corresponding to the second housing member 14 is rotationally supported by the bottom wall 14*a* of the second housing member 14 with a bearing 16.

The end of the rotary shaft 12 corresponding to the second housing member 14 protrudes from the second housing member 14 to the exterior. The end of the rotary shaft 12 corresponding to the second housing member 14 is coupled to an engine serving as an external drive source through a non-illustrated power transmission mechanism. The rotary shaft 12 is rotated by being driven by the engine.

The first housing member 13 accommodates a cylinder block 17 and a swash plate 18. The swash plate 18 includes a plate-shaped body portion 31 with a passing hole 18*h*. The rotary shaft 12 is passed through the passing hole 18*h*. By passing the rotary shaft 12 through the passing hole 18*h*, the swash plate 18 is attached to the rotary shaft 12. The swash plate 18 is inclined with respect to a direction perpendicular to the rotational axis L1 of the rotary shaft 12. The swash plate 18 is inclinable with respect to the direction perpendicular to the rotational axis L1 of the rotary shaft 12. The angle of inclination (the inclination angle) of the swash plate 18 with respect to the direction perpendicular to the rotational axis L1 of the rotary shaft 12 is changeable.

The cylinder block 17 has a cylindrical shape and is arranged closer to the bottom wall 13*a* of the first housing member 13 than the swash plate 18. The cylinder block 17 has an insertion hole 17*a* through which the rotary shaft 12 is inserted. The cylinder block 17 has a small-diameter section 171 and a large-diameter section 172 both having a cylindrical shape. The large-diameter section 172 has an inner diameter greater than that of the small-diameter section 171. The small-diameter section 171 is located closer to the second housing member 14 than the large-diameter section 172. The outer circumferential surface of the rotary shaft 12 and the inner circumferential surface of the small-diameter section 171 are engaged with each other through splines. This allows the rotary shaft 12 and the cylinder block 17 to rotate integrally with each other. A first spring 19 is arranged between the small-diameter section 171 and the bearing 15.

The cylinder block 17 has multiple (in the present embodiment, nine) cylinder bores 17*h* around the rotary shaft 12. The cylinder bores 17*h* are arranged coaxially and spaced apart at equal intervals. Each of the cylinder bores 17*h* accommodates a piston 20 in a reciprocally movable manner. A shoe 21 is arranged at the end of each piston 20 opposed to the swash plate 18. Each piston 20 has a through-hole 20*h* axially extending through the piston 20. Each of the shoes 21 has a through-hole 21*h*. Each of the through-holes 21*h* communicates with one of the through-holes 20*h* and extends through the associated shoe 21.

The shoes 21 are held by an annular retainer plate 22. A cylindrical pivot 23 is arranged on the inner side of the retainer plate 22. The rotary shaft 12 is inserted inside the pivot 23. The outer circumferential surface of the rotary shaft 12 and the inner circumferential surface of the pivot 23 are engaged with each other through splines. This allows the rotary shaft 12 and the pivot 23 to rotate integrally with each other. The urging force of the first spring 19 is transmitted to the pivot 23 through a non-illustrated pin, thus urging the pivot 23 toward the swash plate 18. Then, by being urged toward the swash plate 18, the pivot 23 presses the retainer plate 22 against the swash plate 18. This brings the shoes 21 into tight contact with the surface of the swash plate 18 opposed to the cylinder block 17.

As the rotary shaft 12 rotates, the cylinder block 17 rotates integrally with the rotary shaft 12. This causes the shoes 21 to contact and slide on the surface of the swash plate 18 opposed to the cylinder block 17. The pistons 20 are thus moved around the rotary shaft 12 in the circumferential direction of the rotary shaft 12. As a result, the pistons 20 reciprocate in the cylinder bores 17*h* by the stroke corresponding to the inclination angle of the swash plate 18 as the cylinder block 17 rotates.

Figure 2B:
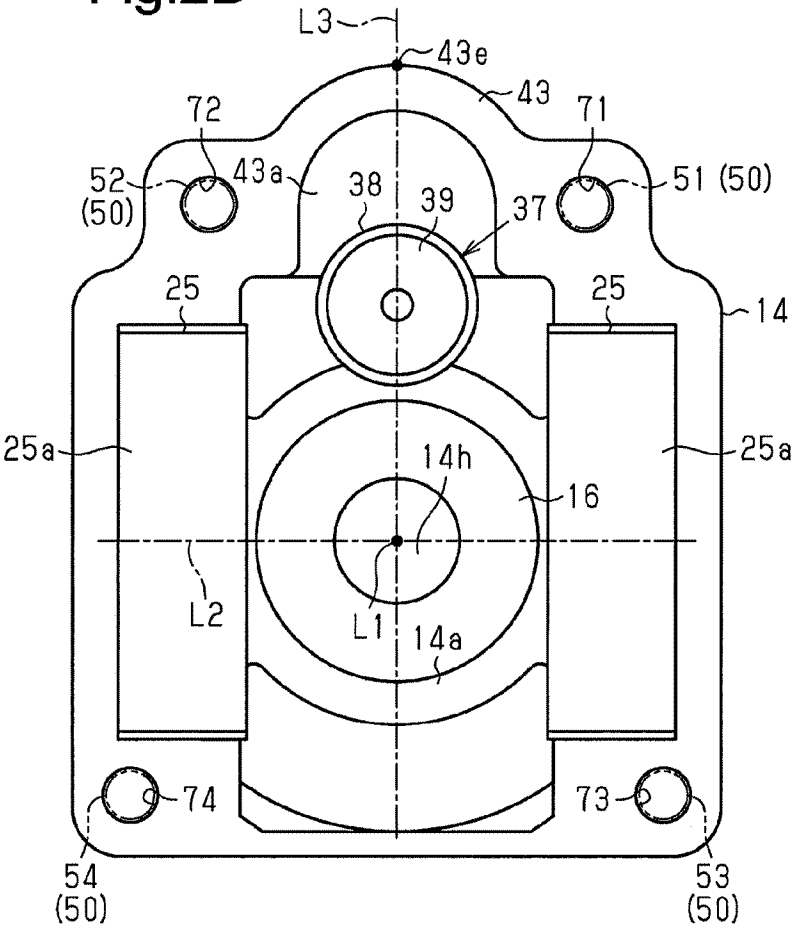
FIG. 2B is a front view showing a second housing member as viewed from the side corresponding to the open end.
Figure 2A:
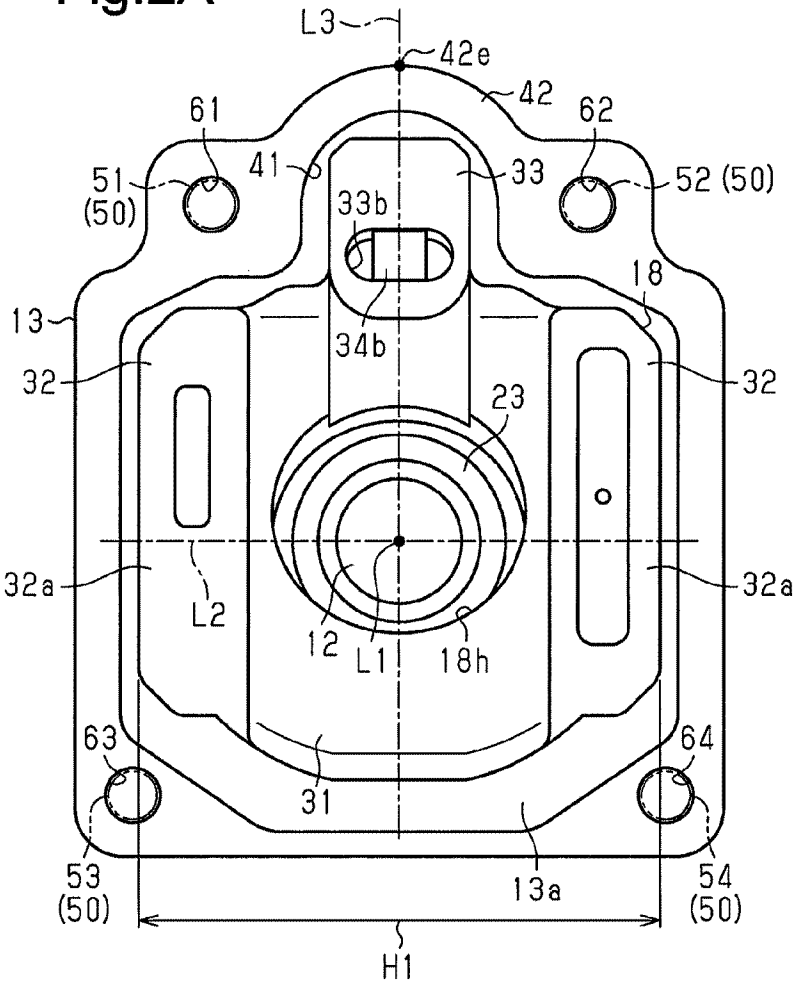
FIG. 2A is a front view showing a first housing member as viewed from the side corresponding to the open end.

As shown in FIG. 2A, the swash plate 18 includes two sliding portions 32 at positions on opposite sides of the body portion 31. The sliding portions 32 are provided integrally with the body portion 31. Each of the sliding portions 32 has a section that protrudes with respect to the end face of the body portion 31 on the side opposite from the side corresponding to the cylinder block 17. Each sliding portion 32 has a sliding surface 32*a*, which is curved in an arcuate shape bulging away from the cylinder block 17.

As shown in FIG. 1, the inner wall of the second housing member 14 has two bushings 25 each serving as a swash plate holding portion. The bushings 25 permit the inclination angle of the swash plate 18 to change and hold the swash plate 18. Each of the bushings 25 has a plate shape curved in an arcuate manner and has a slidable surface 25*a*. The slidable surfaces 25*a* extend in correspondence with the sliding surfaces 32*a*, and the sliding surfaces 32*a* slide on the slidable surfaces 25*a*. By sliding the sliding surfaces 32*a* of the two sliding portions 32 on the slidable surfaces 25*a*, the inclination angle of the swash plate 18 is changed. In this manner, the swash plate 18 inclines about an inclination axis L2. The inclination axis L2 extends through the center of the imaginary circle C1, which is defined in a manner to pass the sliding surfaces 32*a* (the slidable surfaces 25*a*). Also, the inclination axis L2 is perpendicular to the rotational axis L1 of the rotary shaft 12.

The swash plate 18 includes a protrusion 33. The protrusion 33 extends outward of the edge of the body portion 31 corresponding to the top dead center of the piston 20. The protrusion 33 radially protrudes with respect to a section of the sliding surface of the swash plate 18 on which the shoes 21 slide. An accommodating recess 33*a* is provided in the surface of the protrusion 33 opposed to the cylinder block 17. The swash plate 18 includes a columnar contact member 34*a*. The contact member 34*a* is accommodated in the accommodating recess 33*a*. In this state, a section of the contact member 34*a* protrudes from the surface of the protrusion 33 opposed to the cylinder block 17. An accommodating recess 33*b* is provided in the surface of the protrusion 33 on the side opposite from the side corresponding to the cylinder block 17. The swash plate 18 includes a columnar contact member 34*b*. The contact member 34*b* is accommodated in the accommodating recess 33*b*. In this state, a section of the contact member 34*b* protrudes from the surface of the protrusion 33 on the side opposite from the side corresponding to the cylinder block 17.

The bottom wall 13*a* of the first housing member 13 has a suction hole 26 and a discharge hole 27. The suction hole 26 and the discharge hole 27 both have a semi-arcuate shape extending in the circumferential direction of the rotary shaft 12. The suction hole 26 is arranged in the bottom wall 13*a* at a position at which the suction hole 26 is allowed to communicate with the cylinder bores 17*h* accommodating the pistons 20 in the suction strokes. The discharge hole 27 is arranged in the bottom wall 13*a* at a position at which the discharge hole 27 is allowed to communicate with the cylinder bores 17*h* accommodating the pistons 20 in the discharge strokes. The phrase "the pistons 20 in the suction stroke" herein refers to the pistons 20 that are moving from the top dead center to bottom dead center. The phrase "the pistons 20 in the discharge stroke" refers to the pistons 20 that are moving from the bottom dead center to top dead center.

An annular valve plate 28 is arranged between the cylinder block 17 and the bottom wall 13*a* of the first housing member 13. The rotary shaft 12 is inserted inside the valve plate 28. The valve plate 28 is aligned with the cylinder block 17 in the axial direction of the rotary shaft 12. The valve plate 28 has an arcuate communication hole 28*a* around the rotary shaft 12 and has multiple arcuate communication holes 28*b* around the rotary shaft 12. The communication hole 28*a* allows communication between the suction hole 26 and the cylinder bores 17*h*. The communication holes 28*b* allow communication between the discharge hole 27 and the cylinder bores 17*h*. In the present embodiment, three communication holes 28*b* are provided. As the pistons 20 reciprocate, hydraulic oil is drawn from the suction hole 26 into the cylinder bores 17*h* accommodating the pistons 20 in the suction stroke via the communication hole 28*a*. Meanwhile, the hydraulic oil in the cylinder bores 17*h* accommodating the pistons 20 in the discharge stroke is discharged from the discharge hole 27 via the communication holes 28*b*. The suction hole 26 and the communication hole 28*a* constitute a suction port 29 capable of communicating with the cylinder bores 17*h*. The discharge hole 27 and each of the communication holes 28*b* constitute a discharge port 30 capable of communicating with one of the cylinder bores 17*h*.

As shown in FIG. 2A, a recess 41 is provided in a section of the inner circumferential surface of the first housing member 13 and receives the protrusion 33. By arranging the protrusion 33 in the recess 41, the swash plate 18 is accommodated in the housing 11 while being positioned in the circumferential direction of the rotary shaft 12.

As shown in FIG. 1, a piston accommodating chamber 35 is provided in the first housing member 13 at a position outward of the cylinder block 17 in the radial direction of the rotary shaft 12. The piston accommodating chamber 35 communicates with the recess 41 and extends in the axial direction of the first housing member 13. By providing the recess 41 and the piston accommodating chamber 35, a bulging portion 42 is provided in a section of the outer circumferential wall of the first housing member 13. The bulging portion 42 bulges outward and extends in the axial direction of the first housing member 13.

The piston accommodating chamber 35 accommodates a control piston 36. The control piston 36 is capable of selectively protruding from and retracting into the piston accommodating chamber 35. The piston accommodating chamber 35 and the control piston 36 define a control pressure chamber 35*a*. The control pressure chamber 35*a* receives some of the hydraulic oil discharged from the discharge ports 30. The supply amount of the hydraulic oil supplied to the control pressure chamber 35*a* is controlled by a non-illustrated control valve. The end face of the control piston 36 on the side corresponding to the swash plate 18 is in contact with the contact member 34*a*.

A closing portion 43 with a bottom is provided in a section of the outer circumferential wall of the second housing member 14. The closing portion 43 bulges outward in correspondence with the bulging portion 42 to close the opening of the recess 41. A section of the bottom surface of the closing portion 43 configures a stopper 43*a*. The protrusion 33 is capable of contacting the stopper 43*a*.

The bottom wall 14*a* of the second housing member 14 has an inclination angle restoring mechanism 37. The inclination angle restoring mechanism 37 is configured to contact the swash plate 18 to urge the swash plate 18 toward the control piston 36. The inclination angle restoring mechanism 37 includes a tubular spring receiving member 38 with a bottom, a hollow piston 39, and a second spring 39*a*. The hollow piston 39 is inserted into the spring receiving member 38. The second spring 39*a* is accommodated in the hollow piston 39. The spring receiving member 38 is attached to the bottom wall 14*a* using a screw 38*a*. The spring receiving member 38 opens toward the swash plate 18. The urging force of the second spring 39*a* urges the hollow piston 39 away from the bottom of the spring receiving member 38. That is, the second spring 39*a* urges the hollow piston 39 in a direction to increase the inclination angle of the swash plate 18. The end face of the hollow piston 39 opposed to the swash plate 18 is in contact with the contact member 34*b*.

In the variable displacement swash plate type piston pump 10, which has the above-described configuration, when the supply amount of the hydraulic oil supplied to the control pressure chamber 35*a* is increased, the pressure in the control pressure chamber 35*a* is raised. This moves the control piston 36 in a direction protruding from the piston accommodating chamber 35. The control piston 36 thus presses the swash plate 18 through the contact member 34*a* against the urging force of the second spring 39*a* to decrease the inclination angle of the swash plate 18. As a result, the inclination angle of the swash plate 18 decreases, thus decreasing the stroke of each piston 20 to reduce the displacement. When the swash plate 18 is at the minimum inclination angle, the protrusion 33 of the swash plate 18 contacts the stopper 43*a* of the closing portion 43. This maintains the minimum inclination angle of the swash plate 18.

If the supply amount of the hydraulic oil supplied to the control pressure chamber 35*a* is decreased, the pressure in the control pressure chamber 35*a* is lowered. The urging force of the second spring 39*a* thus causes the hollow piston 39 to press the swash plate 18 through the contact member 34*b* to increase the inclination angle of the swash plate 18. This moves the control piston 36 in a direction to retract into the piston accommodating chamber 35. As a result, the inclination angle of the swash plate 18 increases, thus increasing the stroke of each piston 20 to increase the displacement. When the swash plate 18 is at the maximum inclination angle, the supply amount of the hydraulic oil supplied to the control pressure chamber 35*a* is minimum. The control piston 36 is thus maintained in the state maximally retracted in the piston accommodating chamber 35. This maintains the maximum inclination angle of the swash plate 18.

The contact point P1 of the swash plate 18 with the inclination angle restoring mechanism 37 is located in the first housing member 13 when the swash plate 18 is at an inclination angle (the maximum inclination angle) at which the control piston 36 is maximally retracted in the piston accommodating chamber 35. In the present embodiment, the contact point P1 is the point at which the hollow piston 39 and the contact member 34*b* contact each other.

As shown in FIGS. 2A and 2B, the first housing member 13 and the second housing member 14 are fastened to each other by means of multiple bolts 50, each of which is a fastening member. The bolts 50 include a first bolt 51 serving as a first fastening member and a second bolt 52 serving as a second fastening member. The first housing member 13 has a first internal thread hole 61 and a second internal thread hole 62. The first bolt 51 and the second bolt 52 are threaded into the first internal thread hole 61 and the second internal thread hole 62. The first internal thread hole 61 and the second internal thread hole 62 are arranged at positions that are on the opposite sides of the recess 41, inside the width H1 of the swash plate 18 in the direction along the inclination axis L2 of the swash plate 18, and closer to the rotary shaft 12 than a distal end 42*e* and a distal end 43*e* in the bulging direction of the bulging portion 42 and the closing portion 43.

The phrase "the bulging direction of the bulging portion 42 and the closing portion 43" herein refers to the direction that is perpendicular to both the rotational axis L1 of the rotary shaft 12 and the inclination axis L2 of the swash plate 18. The phrase "the distal end 42*e* and the distal end 43*e* in the bulging direction of the bulging portion 42 and the closing portion 43" refers to a section of the bulging portion 42 and a section of the closing portion 43 that are located on the imaginary line L3, which extends in the direction that is perpendicular to both the rotational axis L1 of the rotary shaft 12 and the inclination axis L2 of the swash plate 18.

The bolts 50 also include a third bolt 53 and a fourth bolt 54 other than the first bolt 51 and the second bolt 52. The third bolt 53 and the fourth bolt 54 are the bolts 50 that are located on the opposite side of the sliding portions 32 from the first bolt 51 and the second bolt 52. The open end of the first housing member 13 has a third internal thread hole 63 and a fourth internal thread hole 64. The third bolt 53 and the fourth bolt 54 are threaded into the third internal thread hole 63 and the fourth internal thread hole 64. At least a part of each of the third and fourth internal thread holes 63, 64 is arranged outside the width H1 of the swash plate 18. In the present embodiment, the center of the third internal thread hole 63 and the center of the fourth internal thread hole 64 are arranged outside the width H1 of the swash plate 18. A part of each of the third and fourth internal thread holes 63, 64 is arranged inside the width H1 of the swash plate 18.

The second housing member 14 has a first passing hole 71 at a position coinciding with the first internal thread hole 61 in the axial direction of the first housing member 13 and the second housing member 14. The first bolt 51 is passed through the first passing hole 71. The second housing member 14 also has a second passing hole 72 at a position coinciding with the second internal thread hole 62 in the axial direction of the first housing member 13 and the second housing member 14. The second bolt 52 is passed through the second passing hole 72. The second housing member 14 further has a third passing hole 73 at a position coinciding with the third internal thread hole 63 in the axial direction of the first housing member 13 and the second housing member 14. The third bolt 53 is passed through the third passing hole 73. The second housing member 14 also has a fourth passing hole 74 at a position coinciding with the fourth internal thread hole 64 in the axial direction of the first housing member 13 and the second housing member 14. The fourth bolt 54 is passed through the fourth passing hole 74.

The first bolt 51, the second bolt 52, the third bolt 53, and the fourth bolt 54 are passed through the first passing hole 71, the second passing hole 72, the third passing hole 73, and the fourth passing hole 74, respectively. Each of the first to fourth bolts 51 to 54 is then threaded into the first to fourth internal thread holes 61 to 64. In this manner, the first housing member 13 and the second housing member 14 are fastened to each other. For this purpose, the first bolt 51 and the second bolt 52 are arranged at the positions that are on the opposite sides of the recess 41, inside the width H1 of the swash plate 18 in the direction along the inclination axis L2 of the swash plate 18, and closer to the rotary shaft 12 than the distal ends 42*e*, 43*e* in the bulging direction of the bulging portion 42 and the closing portion 43. Further, at least a part of each of the third and fourth bolts 53, 54 is arranged outside the width H1 of the swash plate 18. In the present embodiment, the center of the third bolt 53 and the center of the fourth bolt 54 are arranged outside the width H1 of the swash plate 18. A part of each of the third and fourth bolts 53, 54 is located inside the width H1 of the swash plate 18.

Figures 3, 4:
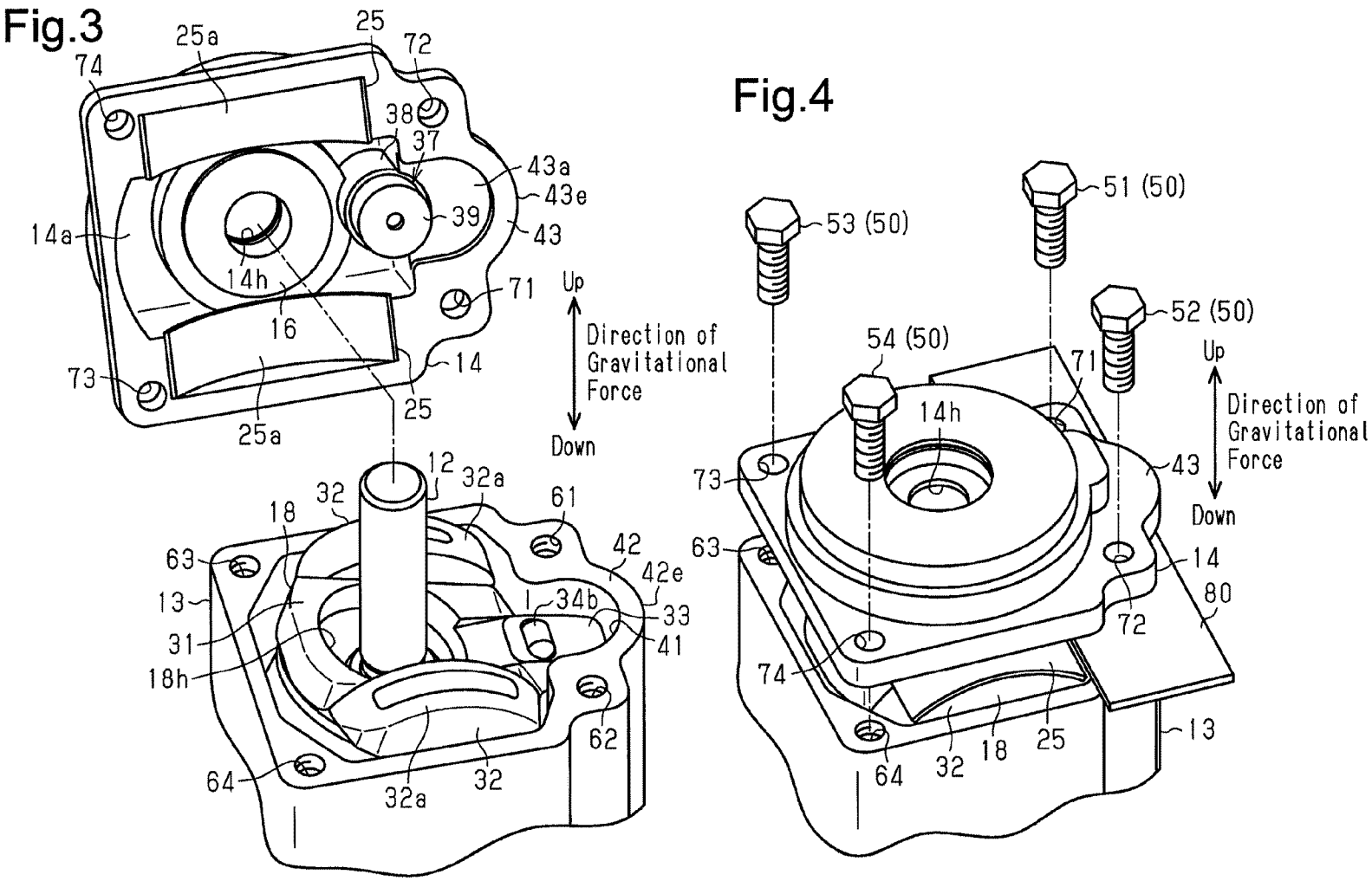
FIG. 3 is an exploded perspective view showing the first housing member and the second housing member.
FIG. 4 is a perspective view showing a state in which the second housing member is joined to the first housing member.

As shown in FIG. 3, to join the first housing member 13 and the second housing member 14 to each other, the first housing member 13 is arranged in a posture in which the opening of the first housing member 13 faces upward in the direction of gravitational force. The cylinder block 17 is placed on the bottom surface of the first housing member 13. The rotary shaft 12 is inserted inside the cylinder block 17, and the control piston 36 is accommodated in the piston accommodating chamber 35. The swash plate 18 is accommodated in the first housing member 13 with the protrusion 33 arranged in the recess 41 and the rotary shaft 12 passed through the inner side of the swash plate 18. By arranging the protrusion 33 in the recess 41, the swash plate 18 is positioned in the circumferential direction of the rotary shaft 12. This facilitates the joining work.

As shown in FIG. 4, the second housing member 14 is joined to the first housing member 13 such that the open end of the first housing member 13 and the open end of the second housing member 14 face and contact each other. At this stage, the hollow piston 39 and the second spring 39*a*, which are components of the inclination angle restoring mechanism 37, are arranged in the second housing member 14. Therefore, if the second housing member 14 is arranged with respect to the first housing member 13 such that the open end of the second housing member 14 is opposed to the open end of the first housing member 13, the hollow piston 39 and the second spring 39*a* will drop, thus complicating the joining work.

For example, a case will now be discussed in which, to join the second housing member 14 to the first housing member 13, the first housing member 13 is arranged in a posture in which the opening of the first housing member 13 faces in the lateral direction. In this case, the hollow piston 39 and the second spring 39*a* are unlikely to drop even if the second housing member 14 is arranged with respect to the first housing member 13 such that the open end of the second housing member 14 is opposed to the open end of the first housing member 13. However, since the rotary shaft 12 is supported by the first housing member 13 in a cantilevered manner, the posture of the first housing member 13 with its opening facing in the lateral direction may cause inclination of the rotary shaft 12 due to the gravitational force. This hampers rotational support of the rotary shaft 12 by the second housing member 14, thus complicating the joining work.

To solve this problem, an anti-drop guide plate 80 is arranged on the open end of the second housing member 14 to keep the hollow piston 39 and the second spring 39*a* from dropping. The guide plate 80 has the shape of a flat rectangular plate such that the guide plate 80 supports the hollow piston 39 and the second spring 39*a* in a manner to keep the hollow piston 39 and the second spring 39*a* from dropping and extends outward of the open end of the first housing member 13 and the open end of the second housing member 14. With the guide plate 80 arranged on the open end of the second housing member 14, the sections of the guide plate 80 extending outward of the open end of the second housing member 14 and the two bushings 25 are held by a hand. In this state, the second housing member 14 is arranged with respect to the first housing member 13 such that the open end of the second housing member 14 is opposed to the open end of the first housing member 13. Thereafter, the first housing member 13 and the second housing member 14 are temporarily fastened to each other using the corresponding bolts 50 (the third bolt 53 and the fourth bolt 54).

At this stage, the control piston 36 is at the position maximally retracted in the piston accommodating chamber 35. If the contact point P1 of the swash plate 18 with the inclination angle restoring mechanism 37 is located outward of the open end of the first housing member 13 and outside the first housing member 13, the guide plate 80 contacts the contact point P1 of the swash plate 18 with the inclination angle restoring mechanism 37. As a result, the distance between the open end of the first housing member 13 and the open end of the second housing member 14 becomes greater than the thickness of the guide plate 80. This may hamper temporary fastening of the first housing member 13 and the second housing member 14 using the bolts 50.

To solve this problem, the contact point P1 of the swash plate 18 with the inclination angle restoring mechanism 37 is set inward of the open end of the first housing member 13 and inside the first housing member 13. As a result, when the second housing member 14 is arranged with respect to the first housing member 13 with the guide plate 80 arranged on the open end of the second housing member 14, such that the open end of the second housing member 14 is opposed to the open end of the first housing member 13, the guide plate 80 contacts the open end of the first housing member without contacting the contact point P1 of the swash plate 18 with the inclination angle restoring mechanism 37. The distance between the open end of the first housing member 13 and the open end of the second housing member 14 thus becomes equal to the thickness of the guide plate 80. This facilitates temporary fastening of the first housing member 13 and the second housing member 14 using the bolts 50, thus facilitating the joining work. Thereafter, the guide plate 80 is removed and then final tightening of the four bolts 50 is accomplished to fasten the first housing member 13 and the second housing member 14 to each other by means of the bolts 50. The first housing member 13 and the second housing member 14 are thus joined to each other.

An operation of the present embodiment will now be described.

As has been described, the variable displacement swash plate type piston pump 10, which has the above-described configuration, is designed in a manner to facilitate the joining work. In the piston pump 10, the bulging portion 42 receives pressure from the hydraulic oil supplied to the control pressure chamber 35*a*. Therefore, the vicinity of the bulging portion 42 in the first housing member 13 is a section on which stress tends to concentrate relatively easily in the first housing member 13. Also, at the time of limiting the inclination angle of the swash plate 18, the protrusion 33 comes into contact with the stopper 43*a* of the second housing member 14 after being moved by receiving the force of the control piston 36. As a result, the vicinity of the closing portion 43 (the stopper 43*a*) in the second housing member 14 is a section on which stress tends to concentrate relatively easily in the second housing member 14.

It is supposed that, for example, the first bolt 51 and the second bolt 52 are arranged at positions that are on the opposite sides of the recess 41, outside the width H1 of the swash plate 18 in the direction along the inclination axis L2 of the swash plate 18, and more spaced from the rotary shaft 12 than the distal ends 42*e*, 43*e* in the bulging direction of the bulging portion 42 and the closing portion 43. Compared to this case, the positions of the first and second bolts 51, 52 of the present embodiment are close to the bulging portion 42 and the closing portion 43. This increases the fastening force between the vicinity of the bulging portion 42 in the first housing member 13 and the vicinity of the closing portion 43 in the second housing member 14. Deformation is thus restrained in the portion of the first housing member 13 and the portion of the second housing member 14 each corresponding to the protrusion 33 of the swash plate 18.

Also, at least a part of each of the third and fourth bolts 53, 54 is arranged outside the width H1 of the swash plate 18. Since the sliding surfaces 32*a* of the sliding portions 32 slide on the slidable surfaces 25*a* of the bushings 25, the bushings 25 receive stress from the swash plate 18. However, compared to a case in which each of the third and fourth bolts 53, 54 is entirely arranged inside the width H1 of the swash plate 18, the stress applied to the bushings 25 from the swash plate 18 is received more easily by the third and fourth bolts 53, 54.

The above-described embodiment has the following advantages.

(1) The first bolt 51 and the second bolt 52 are arranged at positions that are on the opposite sides of the recess 41, inside the width H1 of the swash plate 18 in the direction along the inclination axis L2 of the swash plate 18, and closer to the rotary shaft 12 than the distal ends 42*e*, 43*e* in the bulging direction of the bulging portion 42 and the closing portion 43. It is supposed that the first bolt 51 and the second bolt 52 are arranged at positions that are on the opposite sides of the recess 41, outside the width H1 of the swash plate 18 in the direction along the inclination axis L2 of the swash plate 18, and more spaced from the rotary shaft 12 than the distal ends 42*e*, 43*e* in the bulging direction of the bulging portion 42 and the closing portion 43. Compared to this case, the positions of the first bolt 51 and the second bolt 52 are close to the bulging portion 42 and the closing portion 43. This increases the fastening force between the vicinity of the bulging portion 42 in the first housing member 13 and the vicinity of the closing portion 43 in the second housing member 14. Deformation is thus restrained in the portion of the first housing member 13 and the portion of the second housing member 14 each corresponding to the protrusion 33 of the swash plate 18. As a result, a sufficient sealing performance is ensured in a section on which stress concentrates in the housing 11.

(2) At least a part of each of the third and fourth bolts 53, 54 is arranged outside the width H1 of the swash plate 18. In this manner, compared to a case in which each of the third and fourth bolts 53, 54 is entirely arranged inside the width H1 of the swash plate 18, the stress applied to the bushings 25 from the swash plate 18 is received more easily by the third and fourth bolts 53, 54. This restrains deformation of the first housing member 13 and the second housing member 14, which is otherwise caused by stress applied to the first and second housing members 13, 14 through the bushings 25.

(3) The contact point P1 of the swash plate 18 with the inclination angle restoring mechanism 37 is located in the first housing member 13 when the swash plate 18 is at an inclination angle (the maximum inclination angle) at which the control piston 36 is maximally retracted in the piston accommodating chamber 35. This allows the first housing member 13 and the second housing member 14 to be easily joined to each other as compared to a case in which, when the swash plate 18 is at an inclination angle at which the control piston 36 is maximally retracted in the piston accommodating chamber 35, the contact point P1 of the swash plate 18 with respect to the inclination angle restoring mechanism 37 is located outward of the open end of the first housing member 13 and outside the first housing member 13.

(4) In the present embodiment, the entire housing 11 is reduced in size as compared to the case in which the first bolt 51 and the second bolt 52 are arranged at positions that are on the opposite sides of the recess 41, outside the width H1 of the swash plate 18 in the direction along the inclination axis L2 of the swash plate 18, and more spaced from the rotary shaft 12 than the distal ends 42*e*, 43*e* in the bulging direction of the bulging portion 42 and the closing portion 43.

The above-described embodiment may be modified as follows.

In the above-described embodiment, each of the third and fourth bolts 53, 54 may be entirely arranged inside the width H1 of the swash plate 18.

In the above-described embodiment, the number of the bolts 50 that are different from the first bolt 51 and the second bolt 52 and arranged on the opposite side of the two sliding portions 32 from the first and second bolts 51, 52 may be one or more than two.

In the above-described embodiment, additional fastening members such as bolts may be arranged at positions that are on the opposite sides of the recess 41, outside the width H1 of the swash plate 18 in the direction along the inclination axis L2 of the swash plate 18, and more spaced from the rotary shaft 12 than the distal ends 42*e*, 43*e* in the bulging direction of the bulging portion 42 and the closing portion 43.

In the above-described embodiment, the variable displacement swash plate type piston pump 10 may be configured such that the swash plate 18 is at the minimum inclination angle when the control piston 36 is located at the position maximally retracted in the piston accommodating chamber 35. In this case, when the swash plate 18 is at the maximum inclination angle, the protrusion 33 of the swash plate 18 contacts the stopper 43*a* of the closing portion 43, thus maintaining the maximum inclination angle of the swash plate 18. When the swash plate 18 is at the minimum inclination angle, the supply amount of the hydraulic oil supplied to the control pressure chamber 35*a* is minimum. The control piston 36 is thus maintained at the position maximally retracted in the piston accommodating chamber 35. This maintains the minimum inclination angle of the swash plate 18.

In the above-described embodiment, the inner wall of the second housing member 14 may lack the bushings 25. The inner wall of the second housing member 14 may function as a swash plate holding portion to hold the swash plate 18.

In the above-described embodiment, the body portion 31 may be a separate component from the two sliding portions 32. The sliding portions 32 may be attached to the body portion 31 by means of bolts or the like.

In the above-described embodiment, the swash plate 18 may include a single sliding portion 32.

In the above-described embodiment, a press-fit pin, for example, may be used as a fastening member.

In the above-described embodiment, when the swash plate 18 is at an inclination angle at which the control piston 36 is at the position maximally retracted in the piston accommodating chamber 35, the contact point P1 of the swash plate 18 with the inclination angle restoring mechanism 37 may extend outward of the open end of the first housing member 13 and outside the first housing member 13.

In the above-described embodiment, the hydraulic fluid may be any fluid other than the hydraulic oil. The variable displacement swash plate type piston pump 10 may be any type of pump other than a hydraulic pump.

The invention claimed is:

1. A variable displacement swash plate type piston pump comprising:

a housing;

a rotary shaft, which is rotationally supported by the housing and has a rotational axis;

a cylinder block, which is capable of rotating integrally with the rotary shaft; and a swash plate, which is accommodated in the housing and is inclinable about an inclination axis with respect to a direction perpendicular to the rotational axis of the rotary shaft, wherein the swash plate includes a protrusion extending outward, and the housing includes a tubular first housing member, which accommodates the cylinder block, and a tubular second housing member, which is coupled to an opening side of the first housing member, the first housing member has an inner circumferential surface and an outer circumferential wall, wherein a section of the inner circumferential surface of the first housing member has a recess in which the protrusion is arranged, a piston accommodating chamber, which communicates with the recess, is provided in the first housing member at a position outward of the cylinder block in a radial direction of the rotary shaft, a bulging portion is arranged in a section of the outer circumferential wall of the first housing member by providing the recess and the piston accommodating chamber, wherein the bulging portion bulges outward and extends in an axial direction of the first housing member, the second housing member has an outer circumferential wall, wherein a section of the outer circumferential wall of the second housing member has a closing portion with a bottom that bulges outward along the bulging portion and closes an opening of the recess, a section of a bottom surface of the closing portion configures a stopper that the protrusion is capable of contacting, the piston accommodating chamber accommodates a control piston, which is capable of selectively protruding from and retracting into the piston accommodating chamber, the piston accommodating chamber and the control piston define a control pressure chamber, the first housing member and the second housing member are fastened to each other by means of a plurality of fastening members, and the fastening members include a first fastening member and a second fastening member, wherein the first and second fastening members are arranged at positions that are on opposite sides of the recess, inside a width of the swash plate in a direction along the inclination axis of the swash plate, and closer to the rotary shaft than distal ends of the bulging portion and the closing portion in a bulging direction.

2. The variable displacement swash plate type piston pump according to claim 1, further comprising a swash plate holding portion, which holds the swash plate while permitting change of an inclination angle of the swash plate, wherein the swash plate includes a sliding portion that has a sliding surface curved in an arcuate shape bulging away from the cylinder block, the swash plate holding portion includes a slidable surface that extends along the sliding surface and on which the sliding surface slides, and the fastening members that are different from the first and second fastening members and arranged on the opposite side of the sliding portion from the first and second fastening members each have at least a part arranged outside the width of the swash plate.

3. The variable displacement swash plate type piston pump according to claim 1, further comprising a swash plate inclination angle restoring mechanism, which is arranged in the second housing member and configured to contact the swash plate to urge the swash plate toward the control piston, wherein, when the swash plate is at an inclination angle at which the control piston is at a position maximally retracted in the piston accommodating chamber, a contact point of the swash plate with the swash plate inclination angle restoring mechanism is located in the first housing member.

* * * * *